US008791866B2

(12) United States Patent
Ishihara et al.

(10) Patent No.: US 8,791,866 B2
(45) **Date of Patent: *Jul. 29, 2014**

(54) ANTENNA DEVICE AND WIRELESS COMMUNICATION APPARATUS INCLUDING THE SAME

(75) Inventors: Takashi Ishihara, Ishikawa-gun (JP); Jin Sato, Beijing (CN); Yuji Kaminishi, Ishikawa-gun (JP); Shigekazu Ito, Hakusan (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/451,642

(22) Filed: Apr. 20, 2012

(65) Prior Publication Data

US 2013/0141302 A1 Jun. 6, 2013

Related U.S. Application Data

(63) Continuation of application No. 12/266,099, filed on Nov. 6, 2008, now Pat. No. 8,314,737, which is a continuation of application No. PCT/JP2007/056068, filed on Mar. 23, 2007.

(30) Foreign Application Priority Data

May 11, 2006 (JP) ..... 2006-132803

(51) Int. Cl.
*H01Q 1/24* (2006.01)

(52) U.S. Cl.
USPC ..... 343/702; 343/700 MS

(58) Field of Classification Search
CPC ..... H01Q 1/243; H01Q 1/38; H01Q 9/0421
USPC ..... 343/702, 700 MS
See application file for complete search history.

(56) References Cited

U.S. PATENT DOCUMENTS

| | | | | |
|---|---|---|---|---|
| 5,959,582 | A * | 9/1999 | Kawahata et al. | 343/700 MS |
| 6,476,767 | B2 * | 11/2002 | Aoyama et al. | 343/700 MS |
| 6,614,401 | B2 * | 9/2003 | Onaka et al. | 343/702 |
| 7,126,545 | B2 * | 10/2006 | Nagano et al. | 343/702 |

OTHER PUBLICATIONS

Ishihara; "Antenna Device and Wireless Communication Apparatus Including the Same", U.S. Appl. No. 12/266,099, filed Nov. 6, 2008.

* cited by examiner

*Primary Examiner* — Dameon E Levi
*Assistant Examiner* — Collin Dawkins
(74) *Attorney, Agent, or Firm* — Keating and Bennett, LLP

(57) ABSTRACT

A non-feeding element is provided with a proximity-providing gap from a feeding element, and a resonant state is generated there by capacitive coupling. The non-feeding element resonates at a frequency different from a resonant frequency of the feeding element. The feeding element and the non-feeding element have alongside-ground-terminal extending portions spaced from an edge surface at one end of a ground surface formed on the circuit board and to extend in a direction along the edge surface at the one end of the ground surface. The feeding element and/or the non-feeding element is formed three-dimensionally with a plurality of bending portions so that at least parts of the alongside-ground-terminal extending portion of the feeding element and the ground-terminal extending portion of the non-feeding element have substantially the same amount of spacing from the ground surface.

8 Claims, 4 Drawing Sheets

ANTENNA DEVICE AND WIRELESS COMMUNICATION APPARATUS INCLUDING THE SAME

CROSS-REFERENCE TO RELATED APPLICATIONS

This is a continuation under 35 U.S.C. §111(a) of PCT/JP2007/056068 filed Mar. 23, 2007, and claims priority of JP2006-132803 filed May 11, 2006, both incorporated by reference.

BACKGROUND

1. Technical Field

The present disclosure relates to an antenna device for carrying out wireless communications, and a wireless communication apparatus including the same.

2. Background Art

FIG. 8 is an external view showing an example of a cellular phone as a wireless communication apparatus (refer to Patent Document 1) as viewed from a back side. FIG. 8 is a perspective view showing a case where an LCD (liquid crystal display) and a key unit are provided on the opposite side to that shown in the figure. A cellular phone 40 shown in FIG. 8 includes an antenna element 42 and a non-feeding element 43 contained within a case 41. The antenna element 42 is configured so as to receive RF power from a feeding section 44 at a middle portion of the antenna.

The non-feeding element 43 and the antenna element 42 are provided on the same plane with a mutual gap therebetween, and, for example, attached to an internal wall of the case 41. The non-feeding element 43 is provided near a top end of the interior of the case 41. The antenna element 42 is provided below the non-feeding element 43. The antenna element 42 and the non-feeding element 43 are electromagnetically coupled to each other.

Patent Document 1: Japanese Patent No. 3608735

Cellular phones that are available have various shapes, and the variety is expected to increase. Thus, there is a demand for reduction of an antenna providing space in a cellular phone compared with currently available sizes. However, in the cellular phone 40, the antenna element 42 and the non-feeding element 43 are provided on the same plane with a mutual gap, with the antenna element 42 formed below the non-feeding element 43 (toward the bottom of the phone). Therefore, design flexibility of these elements 42 and 43 is low. Furthermore, antenna characteristics improve as the amount of separation from a ground terminal increases. Thus, it is disadvantageous from the perspective of antenna characteristics to locate the antenna element 42 and the non-feeding element 43 such that the amount of separation of the antenna element 42 is less than the amount of separation of the non-feeding element 43.

That is, in a configuration where a feeding element such as an antenna element and a non-feeding element are provided on the same plane, a design attempt to provide a needed amount of separation from a ground terminal could increase the size of an antenna device. Therefore, it has been difficult to reduce the size of an antenna device or a wireless communication apparatus including an antenna device.

SUMMARY

The antenna device and communication apparatus described herein solve the problems described above by means of the following configuration. That is, one embodiment is directed to:

An antenna device comprising a feeding element connected for receiving RF power from a feeding point on a circuit board, and a non-feeding element provided with a gap from the feeding element, the non-feeding element and the feeding element being configured so as to be capacitively coupled and to thereby generate a resonant state, wherein the non-feeding element is formed so as to resonate at a frequency different from a resonant frequency of the feeding element, and the feeding element and the non-feeding element are provided adjacent (on or in proximity to) the circuit board, wherein the feeding element and the non-feeding element are both formed so as to be separated from an edge surface at one end of a ground surface formed on the circuit board and to extend in a direction along the edge surface at the one end of the ground surface, and portions formed so as to extend in the direction along the edge surface at the one end of the ground surface serve as alongside-ground-terminal extending portions, and wherein at least one of the feeding element and the non-feeding element is formed three-dimensionally with a plurality of bending portions so that at least parts of the alongside-ground-terminal extending portion of the feeding element and the alongside-ground-terminal extending portion of the non-feeding element have substantially the same amount of separation from the ground surface with a mutual gap in a thickness direction of the circuit board.

In the antenna device described above, the feeding element that receives RF power from the contact point on the circuit board, and the non-feeding element provided with the gap from the feeding element, are configured so as to be capacitively coupled and to thereby generate a resonant state. Furthermore, the non-feeding element is formed so as to resonate at a frequency different from a resonant frequency of the feeding element.

The feeding element and the non-feeding element are provided on or in proximity to the circuit board. However, the feeding element and the non-feeding element are both formed so as to be spaced from the edge surface at the one end (the "ground terminal") of the ground surface formed on the circuit board and to extend in the direction along the edge surface at the one end of the ground surface, so that the feeding element and the non-feeding element are unsusceptible to effects of the ground surface.

Furthermore, the feeding element and the non-feeding element have alongside-ground-terminal extending portions formed so as to extend in the direction along the edge surface at the one end of the ground surface. Furthermore, at least one of the feeding element and the non-feeding element is formed three-dimensionally with a plurality of bending portions. With the three-dimensional shape, at least parts of the alongside-ground-terminal extending portion of the feeding element and the alongside-ground-terminal extending portion of the non-feeding element have substantially the same amount of spacing from the ground surface with a mutual gap in a thickness direction of the circuit board. Thus, with the antenna device, a space for providing the antenna device can be used effectively. For example, when the antenna device is provided at a terminal portion of a wireless communication apparatus, the feeding element and the non-feeding element can both be provided in a region of the terminal portion. Therefore, in the antenna device, degradation of antenna gain can be prevented even when the size is small, and favorable antenna characteristics can be achieved.

Other features and advantages will become apparent from the following description of embodiments, which refers to the accompanying drawings.

DETAILED DESCRIPTION

Reference Numerals

Figure 1A:
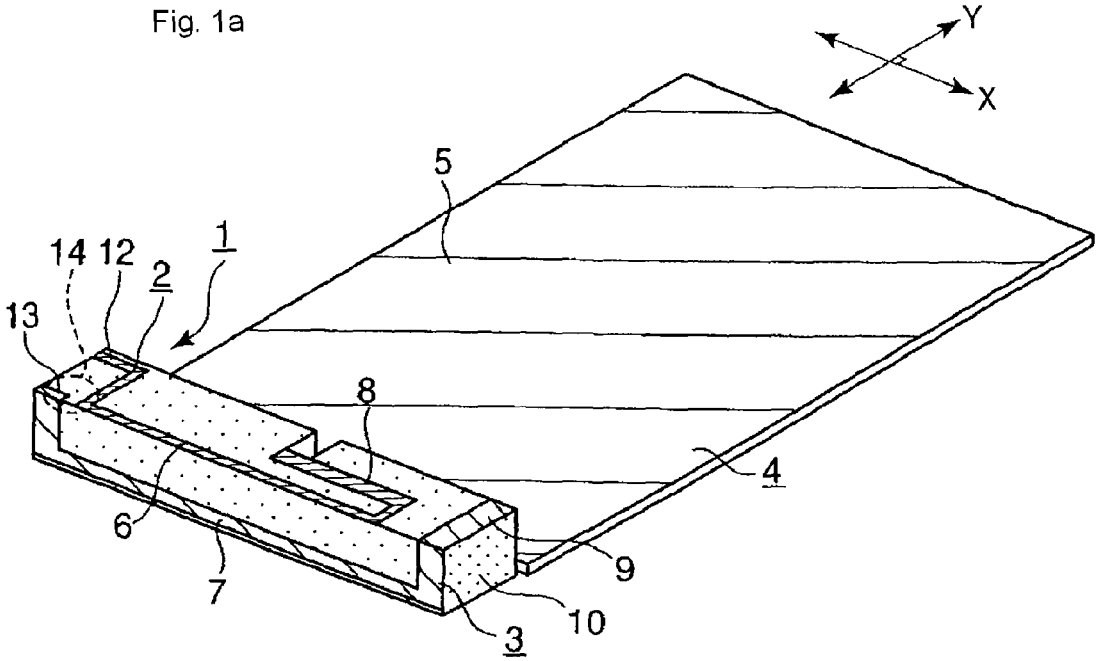
FIG. 1*a* is a schematic perspective view for explaining an antenna device according to a first embodiment.

1 antenna device
2 feeding element
3 non-feeding element
4 circuit board
5 ground surface
6, 7 alongside-ground-terminal extending portions
8 contiguous electrode portions
9, 12, 13 open ends
10 dielectric base
11 branched portion
14 proximity providing region
15 feeding point Now, embodiments will be described with reference to the drawings. Regarding the embodiments, description that is common to more than one embodiment will be omitted or simplified.

Figure 1B:
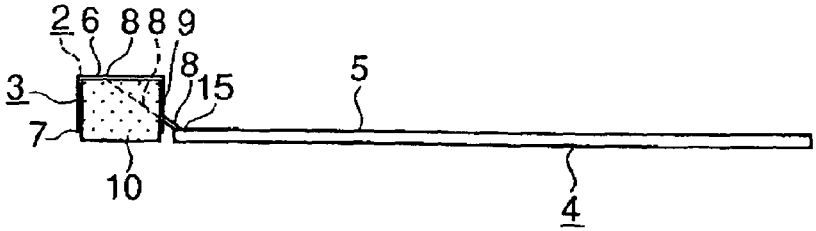
FIG. 1*b* is a schematic side view for explaining the antenna device according to the first embodiment.

FIG. 1*a* is a schematic perspective view showing an antenna device 1 according to a first embodiment, together with a circuit board 4. FIG. 1*b* is a side view showing the antenna device 1 according to the first embodiment, as viewed from the right side in FIG. 1*a*. The antenna device 1 includes a feeding element 2 and a non-feeding element 3. The feeding element 2 receives RF energy via a feeding point 15 (refer to FIG. 1*b*) on the circuit board 4. The non-feeding element 3 is provided with a gap from the feeding element 2. The non-feeding element 3 and the feeding element 2 are configured so as to be capacitively coupled via a region provided in proximity so that the non-feeding element 3 and the feeding element 2 generate a resonant state.

The feeding element 2 and the non-feeding element 3 are both provided in proximity to the circuit board 4 via a dielectric base 10 provided outside the circuit board 4. The circuit board 4 may have a rectangular shape. The feeding element 2 and the non-feeding element 3 are attached to the circuit board 4 in the form of circuit patterns formed on the surface of the dielectric base 10. In the first embodiment, a ground surface 5 is formed over the entire surface of the circuit board 4. The feeding element 2 and the non-feeding element 3 are both formed so as to project outside (be separated) from one end of the circuit board 4. Thus, the feeding element 2 and the non-feeding element 3 are both formed so as to project outside from an edge surface at one end of the ground surface 5.

Furthermore, the feeding element 2 and the non-feeding element 3 are both formed so as to extend in a direction along the edge surface at one edge of the ground surface 5 (i.e., in this embodiment, in an X direction along an edge surface associated with a shorter side of the circuit board 4). The portions formed so as to extend in the direction along the edge surface at the one edge of the ground surface 5 individually serve as alongside-ground-terminal extending portions 6 and 7. The alongside-ground-terminal extending portion 6 has a surface that is formed substantially in parallel to the board surface of the circuit board 4. The alongside-ground-terminal extending portion 7 of the non-feeding element 3 has a surface that is formed at least substantially perpendicularly to the board surface of the circuit board 4.

The non-feeding element 3 is formed to have a three-dimensional shape with a plurality of bending portions. A feature of this embodiment is the three-dimensional shape of the non-feeding element 3 formed as described above. More specifically, at least parts of the alongside-ground-terminal extending portion 6 of the feeding element 2 and the alongside-ground-terminal extending portion 7 of the non-feeding element 3 have a mutual gap in a thickness direction of the circuit board 4, with substantially the same amount of projection outside (physical separation from) the ground surface 5.

The feeding element 2 has a contiguous electrode portion 8. The contiguous electrode portion 8 is contiguous with the alongside-ground-terminal extending portion 6. Furthermore, the contiguous electrode portion 8 is extended non-linearly from one end of the alongside-ground-terminal extending portion 6 and connected to a feeding terminal (a terminal provided at the feeding point 15) provided at the one end of the circuit board 4.

More specifically, the contiguous electrode portion 8 is extended from the one end of the alongside-ground-terminal extending portion 6 along an upper surface of the dielectric base 10 in a Y direction along a longer side of the circuit board 4, and then the direction of extension is changed in the middle of the dielectric base 10 so that the contiguous electrode portion 8 is extended in an X direction along the alongside-ground-terminal extending portion 6, so that the contiguous electrode portion 8 has a non-linear shape. Then, the contiguous electrode portion 8 is extended diagonally downward toward the circuit board 4 and is thereby connected to the feeding point 15 of the circuit board 4. (FIG. 1*b*.)

Furthermore, the feeding element 2 has an open end 12. The open end 12 is contiguous with the other end of the alongside-ground-terminal extending portion 6. On the side of the open end 12, the feeding element 2 has a surface that is formed substantially in parallel to the board surface of the circuit board 4. On the side of the open end 12, the feeding element 2 is extended in the Y direction toward the circuit board 4, and the direction of extension is then changed to the X direction along the edge surface at the one end of the circuit board 2.

The non-feeding element 3 is not electrically connected to the ground surface 5 of the circuit board 5. The non-feeding element 3 has an open end 13 and an open end 9. The open end 13 is contiguous with one end of the alongside-ground-terminal extending portion 7, and is located on the side near the open end 12 of the feeding element 2. The open end 9 is contiguous with the other end of the alongside-ground-terminal extending portion 7, and is located on the side near the contiguous electrode portion 8 of the feeding element 2.

The open end 9 is extended upward from one end of the alongside-ground-terminal extending portion 7 along a front surface of the dielectric base 10, and is bent at a top end thereof Furthermore, the open end 9 is extended in the Y direction along a longer side of the circuit board 4 on the upper surface of the dielectric base 10. Furthermore, the open end 9 is bent at an end on the side of the circuit board 4, and is extended toward the circuit board 4 along a surface of the dielectric base 10 on the side of the circuit board 4. (FIG. 1*b*.) As described above, the open end 9 is formed three-dimensionally, so that the non-feeding element 3 is formed three-dimensionally.

The open end 13 is extended upward on the same surface as the alongside-ground-terminal extending portion 7, and is then bent at a top end thereof Furthermore, the open end 13 is extended toward the circuit board 4, on the same surface with and in proximity to the open end 12 of the feeding element 2, thereby defining a proximity providing region 14 which serves as a capacitive coupling region between the feeding element 2 and the non-feeding element 3.

The non-feeding element 3 is formed so as to resonate at a frequency different from a resonant frequency of the feeding element 2. The non-feeding element 3 is formed so that one half of the wavelength corresponding to the resonant frequency of the non-feeding element 3 is substantially equal to the effective electrical length of the non-feeding element 3. Similarly, the effective electrical length of the feeding element 2 is also a half-wavelength and is adjusted in accordance with the designed resonant frequency of the feeding element 2.

Figure 2A:
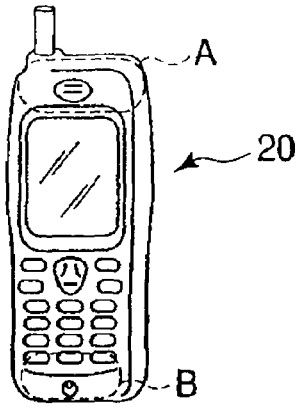
FIG. 2*a* is an external view of a cellular phone for explaining an example of a position at which an antenna device is provided in a cellular phone.
Figure 2B:
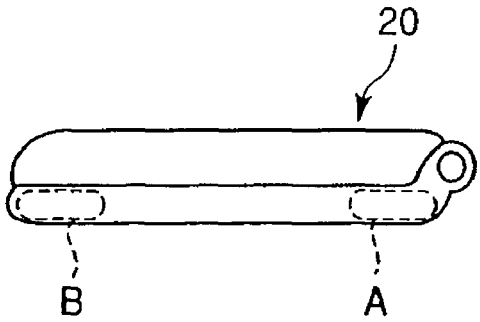
FIG. 2*b* is an illustration for explaining an example of a position at which an antenna device is provided in a cellular phone, showing a state where a foldable cellular phone is folded.
Figure 2C:
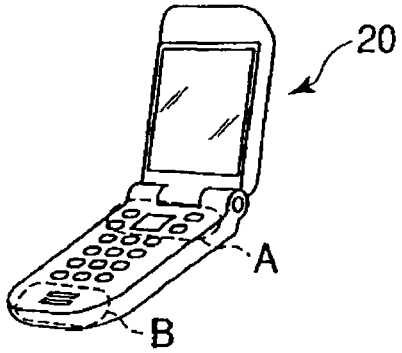
FIG. 2*c* is an illustration for explaining an example of a position at which an antenna device is provided in a cellular phone, showing a state where a foldable cellular phone is unfolded.

The antenna device 1 according to this embodiment is configured as described above, and is provided, for example, on a terminal side (either an end position indicated as A or an end position indicated as B in the figure) of a cellular phone 20, as shown in FIGS. 2*a*, 2*b*, and 2*c*. Assuming that the cellular phone 20 is a foldable cellular phone as shown in FIGS. 2*b* and 2*c*, the terminal side refers to an end in a folded state (a state shown in FIG. 2*b*). In this case, the cellular phone 20 can be formed by providing the antenna device 1 at either the position indicated as A or B in FIG. 2*b*.

In this embodiment, when a communication signal has been supplied from the circuit board 4 to the feeding element 2 via the feeding point 15, the feeding element 2 is excited according to the communication signal. Furthermore, the feeding element 2 and the non-feeding element 3 are capacitively coupled via the proximity providing region 14 to generate a resonant state. The non-feeding element 3 executes an antenna operation while resonating at a frequency different from a resonant frequency of the feeding element 2 (while generating a multiple resonant state).

In this embodiment, the feeding element 2 and the non-feeding element 3 are both formed so as to project outside (to be spaced) from the edge surface at the one end (the "ground terminal") of the ground surface 5 formed on the circuit board 4 and extended in the direction along the edge surface at the one end of the ground surface 5. Thus, the antenna operation in this embodiment is unsusceptible to the effect of the ground surface 5. Therefore, in the antenna device 1 according to this embodiment, even when the size is small, degradation of antenna gain can be prevented, so that favorable antenna characteristics can be achieved.

Furthermore, in this embodiment, portions of the feeding element 2 and the non-feeding element 3, formed so as to extend in the direction along the edge surface at the one end of the ground surface 5, serve as the alongside-ground-terminal extending portions 6 and 7. Furthermore, the non-feeding element 3 is formed three-dimensionally with a plurality of bending portions. With these features, at least parts of the alongside-ground-terminal extending portion 6 of the feeding element 2 and the alongside-ground-terminal extending portion 7 of the non-feeding element 3 have a mutual vertical gap, with substantially the same amount of spacing from the ground surface 5. Thus, according to this embodiment, a space for providing the antenna device 1 can be used effectively.

When the antenna device 1 according to this embodiment is provided in a terminal portion of a wireless communication apparatus, such as the cellular phone 20 shown in FIGS. 2*a*, 2*b*, and 2*c*, the feeding element 2 and the non-feeding element 3 are both provided in a region on the terminal side of the wireless communication apparatus. Thus, the wireless communication apparatus, such as the cellular phone 20, can execute wireless communications favorably using the antenna device 1 according to this embodiment.

Furthermore, in this embodiment, the feeding element 2 and the non-feeding element 3 are attached to the circuit board 4 in the form of patterns formed on the dielectric base 10 provided so as to be spaced from the one end of the circuit board 4. Thus, the feeding element 2 and the non-feeding element 3 can be provided readily and accurately in proximity to the circuit board 4.

Furthermore, in this embodiment, the feeding element 2 has the contiguous electrode portion 8 on the side of one end of the alongside-ground-terminal extending portion 6, the contiguous electrode portion 8 extending non-linearly from the one end of the alongside-ground-terminal extending portion 6 toward the feeding terminal of the circuit board 4. Furthermore, the feeding element 2 has the open end 12 on the side of the other end of the alongside-ground-terminal extending portion 6. According to this embodiment, with the contiguous electrode portion 8 and the open end 12 configured as described above, the design flexibility of the feeding element 12 is increased, so that flexible design of the feeding element 2 is allowed. Furthermore, the non-feeding element 3 has the open end 9 and the open end 13 having three-dimensional shapes and provided contiguously with the alongside-ground-terminal extending portion 7. Thus, according to this embodiment, the non-feeding element 3 can also be designed flexibly. Accordingly, with the antenna device 1 according to this embodiment, even when the size is small, the feeding element 2 and the non-feeding element 3 can be formed with desired shapes and lengths, so that it is readily possible to adjust resonant frequencies to desired values.

Furthermore, in this embodiment, the dielectric base 10 is provided, and the dielectric base 10 has formed thereon patterns of the feeding element 2 and the non-feeding element 3. Thus, the feeding element 2 and the non-feeding element 3 can be formed readily and precisely on the dielectric base 10. Furthermore, with the dielectric base 10, compared with a case where the dielectric base 10 is not provided, due to the wavelength shortening effect of the dielectric base 10, it is possible to achieve designed resonant frequencies with shorter lengths of the feeding element 2 and the non-feeding element 3.

Now, a second embodiment will be described. In the description of the second embodiment, parts that are configured the same as parts in the first embodiment are designated by the same numerals, and repeated description of the common parts is refrained.

Figure 3:
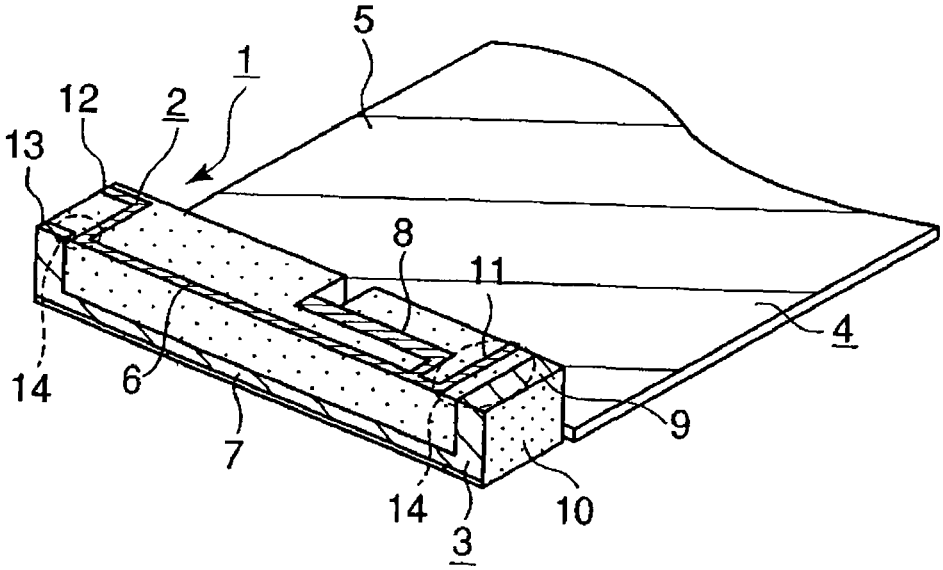
FIG. 3 is a diagram for explaining an antenna device according to a second embodiment.

FIG. 3 is a schematic perspective view showing an antenna device 1 according to the second embodiment, together with the circuit board 4. The configuration according to the second embodiment is substantially the same as the configuration according to the first embodiment. However, the second embodiment differs from the first embodiment in that a proximity providing region 14 is formed with a branched portion 11 provided in proximity to the open end 9 of the non-feeding element 3, the branched portion 11 branching from the alongside-ground-terminal extending portion 6 of the feeding element 2. In the second embodiment, two regions serve as capacitive coupling regions between the feeding element 2 and the non-feeding element 3, namely, the proximity providing region 14 described above, and the proximity region 14 formed at a position corresponding to that in the first embodiment described earlier. Alternatively, the branched portion 11 may be formed so as to branch from the contiguous electrode portion 8 instead of the alongside-ground-terminal extending portion 6.

According to the second embodiment configured as described above, advantages similar to the advantages of the first embodiment described earlier can be achieved. Furthermore, in the second embodiment, the branched portion 11 branching from the alongside-ground-terminal extending portion 6 of the feeding element 2 is formed, the branched portion 11 being provided in proximity to the open end 9 of the non-feeding element 3. As described above, according to the second embodiment, with the branched portion 11 provided in proximity to the open end 9, matching of the non-feeding element 3 can be controlled without affecting resonance of the feeding element 2 itself.

Now, a third embodiment will be described. In the description of the third embodiment, parts that are configured the same as parts in the first and second embodiments are designated by the same numerals, and repeated description of the common parts is refrained.

Figure 4:
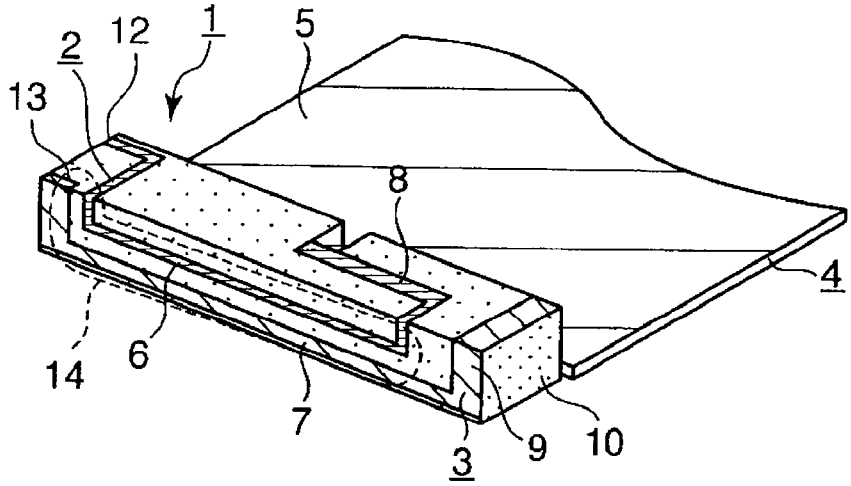
FIG. 4 is a diagram for explaining an antenna device according to a third embodiment.

FIG. 4 is a schematic perspective view showing an antenna device 1 according to the third embodiment, together with the circuit board 4. In the third embodiment, both the feeding element 2 and the non-feeding element 3 are formed three-dimensionally with a plurality of bending portions. More specifically, in the third embodiment, the contiguous electrode portion 8 of the feeding element 2 is formed so as to bend toward a lower part at a distal end of horizontal projection. Furthermore, the alongside-ground-terminal extending portion 6 is formed on a lower side of a top end of the feeding element 2.

The alongside-ground-terminal extending portion 6 has a surface that is formed substantially perpendicularly to or perpendicularly to the board surface of the circuit board 4. Furthermore, the alongside-ground-terminal extending portion 6 is formed in the same plane as the alongside-ground-terminal extending portion 7 of the feeding element 2, the plane being substantially parallel to the thickness direction of the circuit board 4. The alongside-ground-terminal extending portion 6 of the feeding element 2 and the alongside-ground-terminal extending portion 7 of the non-feeding element 3 are provided in proximity to each other. A proximity providing region 14 extending from the proximity providing region of described above to the region where the open ends 12 and 13 are provided in proximity to each other similarly to the first embodiment serves as a capacitive coupling region between the feeding element 2 and the non-feeding element 3.

According to the third embodiment configured as described above, advantages similar to the advantages of the first embodiment can be achieved. Furthermore, in the third embodiment, in the feeding element 2 and the non-feeding element 3, the alongside-ground-terminal extending portions 6 and 7 having long lengths are provided in proximity to each other. Thus, the length of the proximity providing region 14 can be extended, so that the coupling between the feeding element 2 and the non-feeding element 3 can be enhanced. Furthermore, the alongside-ground-terminal extending portion 6 of the feeding element 2 and the alongside-ground-terminal extending portion 7 of the non-feeding element 3 are formed in the same plane substantially parallel to the thickness direction of the circuit board 4. Thus, according to the third embodiment, the surface of the alongside-ground-terminal extending portion 6 of the feeding element 2 and the surface of the alongside-ground-terminal extending portion 7 of the non-feeding element 3 are provided with substantially the same amount of separation from the ground surface 5. Therefore, according to the third embodiment, antenna characteristics, such as antenna efficiency, can be improved further.

Now, a fourth embodiment will be described. In the description of the fourth embodiment, parts that are configured the same as parts in the first to third embodiments are designated by the same numerals, and repeated description of the common parts will be refrained.

Figure 5:
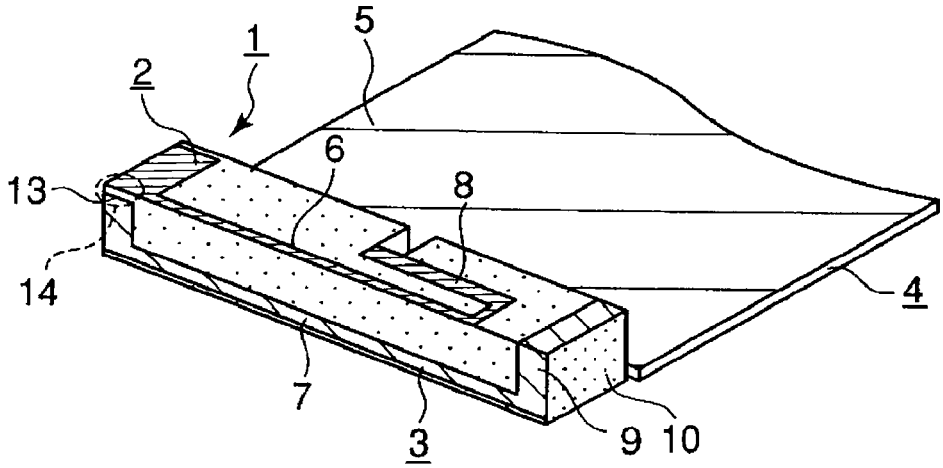
FIG. 5 is a diagram for explaining an antenna device according to a fourth embodiment.

FIG. 5 is a schematic perspective view showing an antenna device 1 according to the fourth embodiment, together with the circuit board 4. In the fourth embodiment, the open end 13 of the non-feeding element 3, located on the side of the open end 12 of the feeding element 2, is extended from the alongside-ground-terminal extending portion 7 of the non-feeding element 3 without any bending portion. Furthermore, the open end 13 and the alongside-ground-terminal extending portion 7 of the non-feeding element 3 are formed in the same plane with each other. Thus, the alongside-ground-terminal extending portion 6 of the feeding element 2 has an extended length along the edge surface at the one end of the ground surface 5. In the fourth embodiment, a proximity providing region 14 of the alongside-ground-terminal extending portion 6 of the feeding element 2 and the open end 13 of the non-feeding element 3 serves as a capacitive coupling region between the feeding element 2 and the non-feeding element 3.

According to the fourth embodiment configured as described above, advantages similar to the advantages of the first embodiment can be achieved. Furthermore, according to the fourth embodiment, the alongside-ground-terminal extending portion 6 of the feeding element 2 can be formed with an extended length along the edge surface at the one end of the ground surface 5. Therefore, according to the fourth embodiment, antenna characteristics, such as antenna efficiency, can be improved.

Now, a fifth embodiment will be described. In the description of the fifth embodiment, parts that are configured the same as parts in the first to fourth embodiments are designated by the same numerals, and repeated description of the common parts will be refrained.

Figure 6:
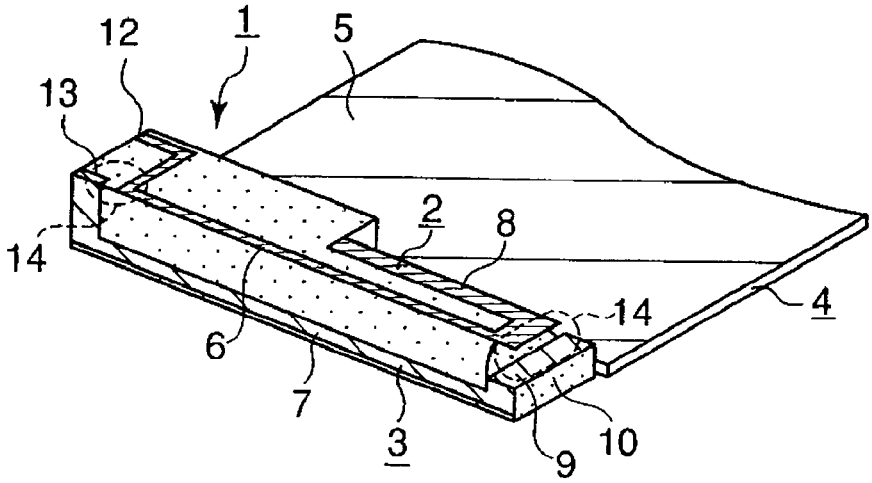
FIG. 6 is a diagram for explaining an antenna device according to a fifth embodiment.

FIG. 6 is a schematic perspective view showing an antenna device 1 according to the fifth embodiment, together with the circuit board 4. In the fifth embodiment, the contiguous electrode portion 8 of the feeding element 2 and the open end 9 of the non-feeding element 3 located on the side near to the contiguous electrode portion 8 are provided in proximity to each other with a gap in the thickness direction of the circuit board 4. In the fifth embodiment, two regions serve as capacitive coupling regions between the feeding element 2 and the non-feeding element 3, namely, this proximity providing region 14 described above, and the proximity region 14 formed at a position corresponding to that in the first embodiment.

For simplicity of description, in FIG. 6, the dielectric base 10 in a region where the feeding element 2 and the non-feeding element 3 have different heights is not shown. Actually, however, the dielectric base 10 is also provided in this region. The open end 9 is provided partially inside the dielectric base 10.

According to the fifth embodiment configured as described above, the alongside-ground-terminal extending portion 6 of the feeding element 2 can be formed with an extended length along the edge surface at the one end of the ground surface 5. Therefore, according to the fifth embodiment, advantages similar to the advantages of the fourth embodiment can be achieved.

As described above, with the antenna devices 1 according to the embodiments, favorable antenna characteristics can be achieved even if the size is small, so that an antenna space of a wireless communication apparatus can be used effectively. Thus, by providing the antenna device 1 according to any one of the embodiments described above on the terminal side (preferably at an end) of a cellular phone, a cellular phone having favorable antenna characteristics can be provided. Furthermore, a wireless communication apparatus including the antenna device 1 according to any one of the embodiments described above, with the antenna device 1 having favorable advantages as described above, can be implemented in a small size and can be configured to have desired characteristics.

The antenna device is not limited to the embodiments described above, and may be embodied in various forms. For example, in each of the embodiments described above, the dielectric base 10 is provided, and the dielectric base 10 having formed thereon patterns of the feeding element 2 and the non-feeding element 3 is attached to the circuit board 4. However, in the antenna device 1, for example, as shown in FIG. 7, the dielectric base 10 may be omitted, and the feeding element 2 and the non-feeding element 3 may be formed in plate-like forms and attached to the circuit board 4.

Figure 7:
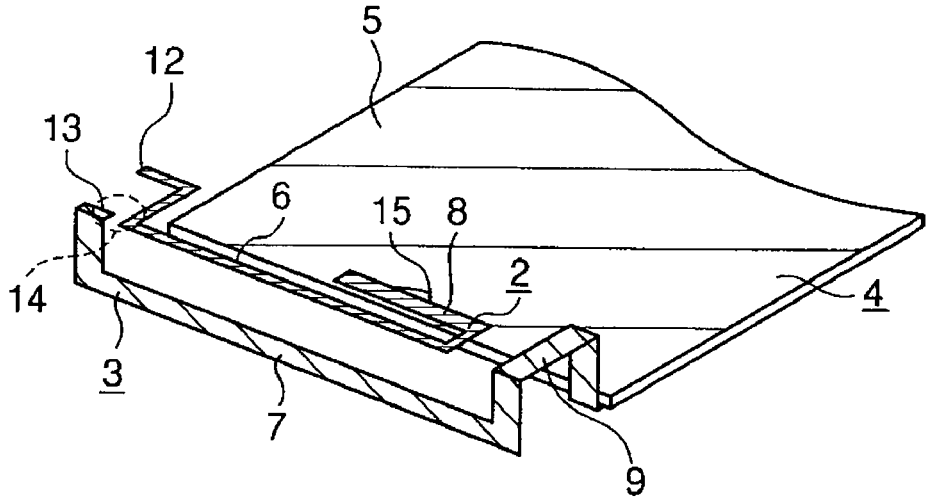
FIG. 7 is a diagram for explaining an antenna device according to another embodiment.
Figure 8:
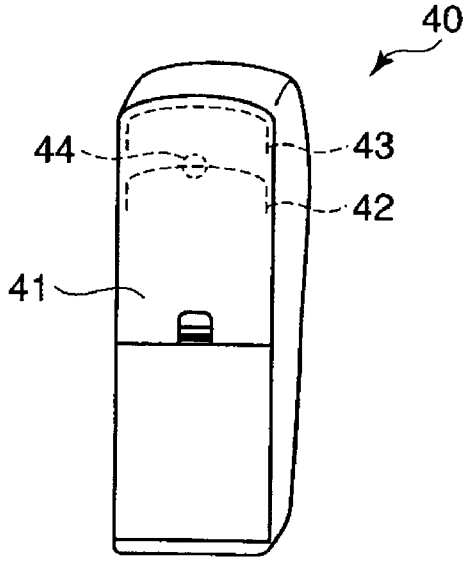
Fig. 8 PRIOR ART
FIG. 8 is a diagram for explaining an antenna device described in Patent Document 1.

FIG. 7 shows an example where the feeding element 2 and the non-feeding element 3 are formed in shapes similar to the shapes of the feeding element 2 and the non-feeding element 3 in the first embodiment. Alternatively, the feeding element 2 and the non-feeding element 3 having shapes similar to the shapes of the feeding element 2 and the non-feeding element 3 in the second to fifth embodiments may be formed without using the dielectric base 10. Furthermore, the antenna device 1 can be constructed by forming the feeding element 2 and the non-feeding element 3 having other shapes without using the dielectric base 10.

Furthermore, in each of the embodiments described above, the contiguous electrode portion 8 of the feeding element 2 is extended non-linearly from the one end of the alongside-ground-terminal extending portion 6. Alternatively, the contiguous electrode portion 8 may be extended linearly so as to be connected from the one end of the alongside-ground-terminal extending portion 6 to the feeding terminal provided on the circuit board 4. It is preferable to form the contiguous electrode portion 8 with a non-linear shape, since the electrical length of the feeding element 2 becomes longer and it is easier to adjust the electrical length to a desired value.

Furthermore, in each of the embodiments described above, the feeding element 2 is provided on the inner side (toward the circuit board) of the non-feeding element 3.

However, the positions of the feeding element 2 and the non-feeding element 3 may be the opposite. For example, in each of the embodiments described above, the feeding point 15 is provided in a middle portion of the edge at the one end of the circuit board 4, and the feeding element 2 is connected to the feeding point 15. However, the position of the feeding point 15 is not particularly limited, and may be determined as appropriate. Thus, it is possible to provide the feeding point 15 at an edge (such as a corner side) of the circuit board 4 and to connect the feeding element 2 to the feeding point 15, the feeding element 2 being formed similarly to the non-feeding element 3 in one of the embodiments described above.

Furthermore, although the ground surface 5 is formed on the entire surface of the circuit board 4 in each of the embodiments described above, the ground surface 5 may be formed on a partial region of the circuit board 4. In this case, in an antenna device 1, the feeding element 2 and the non-feeding element 3 may be formed on the circuit board 4 as long as the feeding element 2 and the non-feeding element 3 are spaced away from the edge surface at the one end of the ground surface 5. Furthermore, when the dielectric base 10 is provided, the dielectric base 10 may be provided on the circuit board 4.

Furthermore, although one or two regions serve as capacitive coupling regions between the feeding element 2 and the non-feeding element 3 in each of the embodiments described above, three or more capacitive coupling regions may be provided.

Furthermore, although the circuit board 4 has a rectangular shape in each of the embodiments described above, the circuit board 4 may have a non-rectangular shape.

Furthermore, although examples where the antenna device 1 according to each of the embodiments is used in a cellular phone have been described above, a wireless communication apparatus other than a cellular phone may be constructed with the antenna device.

An antenna device that can prevent degradation of antenna gain and achieve favorable antenna characteristics can be provided. Thus, the antenna device is suitable for a wireless communication apparatus such as a cellular phone, which requires size reduction and favorable antenna characteristics, and is also suitable for other wireless communication apparatus.

Although particular embodiments have been described, many other variations and modifications and other uses will become apparent to those skilled in the art. Therefore, the present invention is not limited by the specific disclosure herein.

What is claimed is:

1. An antenna device comprising:

a feeding element connected to receive RF power from a feeding point on a circuit board; and a non-feeding element arranged such that a gap is provided between the non-feeding element and the feeding element, the non-feeding element and the feeding element being configured so as to be in proximity and capacitively coupled to one another to thereby generate a resonant state; wherein the non-feeding element is arranged so as to resonate at a frequency different from a resonant frequency of the feeding element, and the feeding element and the non-feeding element are provided adjacent to the circuit board with the feeding element connected to the feeding point on the circuit board;

the feeding element and the non-feeding element are both arranged with a spacing from an edge surface at one end of a ground surface provided on the circuit board and to extend in a direction along the edge surface at the one end of the ground surface, and portions of the feeding element and the non-feeding element are arranged so as to extend in the direction along the edge surface at the one end of the ground surface to define alongside-ground-terminal extending portions;

the feeding element includes a contiguous electrode portion extending non-linearly from one end of the alongside-ground-terminal extending portion of the feeding element towards the feeding point of the circuit board;

the non-feeding element includes a first open end and a second open end each having a three-dimensional shape;

the feeding element includes an open end;

one of the first and second open ends of the non-feeding element is adjacent to and capacitively coupled with the open end of the feeding element; and the non-feeding element is not electrically connected to the ground surface; and the non-feeding element is configured to resonate at $\lambda/2$, where $\lambda$ is a wavelength of a communication signal of the antenna device.

2. The antenna device according to claim 1, wherein the alongside-ground-terminal extending portion of at least one of the feeding element and the non-feeding element includes a surface that is arranged substantially in parallel to a main surface of the circuit board.

3. The antenna device according to claim 2, wherein the non-feeding element is not electrically connected to the ground surface of the circuit board, and the first open end of the non-feeding element is contiguous with the alongside-ground-terminal extending portion of the non-feeding element and located on a side near the open end of the feeding element, and the second open end is contiguous with the alongside-ground-terminal extending portion of the non-feeding element and located on a side near the contiguous electrode portion of the feeding element.

4. The antenna device according to claim 3, wherein a branched portion is arranged to branch from the alongside-ground-terminal extending portion or the contiguous electrode portion of the feeding element, the branched portion being arranged in proximity and providing capacitive coupling to the second open end of the non-feeding element on the side near the contiguous electrode portion of the feeding element.

5. The antenna device according to claim 3, wherein the contiguous electrode portion of the feeding element and the second open end of the non-feeding element located on the side near the contiguous electrode portion are arranged in proximity to one another and provide capacitive coupling to each other with a mutual gap in a thickness direction of the circuit board.

6. The antenna device according to claim 1, comprising a dielectric base, wherein the dielectric base includes patterns of the feeding element and the non-feeding element provided thereon and is attached to the circuit board.

7. A wireless communication apparatus comprising the antenna device according to claim 1, wherein said apparatus supplies said RF power to the antenna device at said feeding point on the circuit board.

8. The wireless communication apparatus according to claim 7, wherein the wireless communication apparatus is a cellular phone including a case, and the antenna device is provided on a terminal side inside the case of the cellular phone.

* * * * *